United States Patent [19]

Allen, Jr.

[11] Patent Number: 4,605,055

[45] Date of Patent: Aug. 12, 1986

[54] METHOD AND APPARATUS FOR CASTING FERROALLOYS AND SLAGS IN MOULDS HAVING A LARGE RATIO OF MOULD MASS TO CAVITY SIZE

[75] Inventor: Thomas R. Allen, Jr., Sewickley, Pa.

[73] Assignee: Economy Industrial Corporation, Ambridge, Pa.

[21] Appl. No.: 662,968

[22] Filed: Oct. 19, 1984

[51] Int. Cl.[4] ..... B22D 11/06

[52] U.S. Cl. ..... 164/479; 164/429

[58] Field of Search ..... 164/342, 324, 329, 72, 164/479, 429, 430, 130, DIG. 6; 249/135, 174

[56] References Cited

U.S. PATENT DOCUMENTS

| | | | |
|---|---|---|---|
| 2,632,216 | 3/1953 | McQuaid | 164/342 X |
| 3,100,322 | 8/1963 | Watanabe et al. | 164/329 X |
| 3,645,321 | 2/1972 | Robinson | 164/324 X |
| 3,727,666 | 4/1973 | Vander-Sluis | 164/72 |
| 3,735,797 | 5/1973 | Jeanneret | 164/72 |
| 4,316,496 | 2/1982 | Spenceley | 164/324 X |

*Primary Examiner*—Nicholas P. Godici
*Assistant Examiner*—M. Jordan
*Attorney, Agent, or Firm*—Parmelee, Miller, Welsh & Kratz

[57] ABSTRACT

A method and apparatus for continuously casting small shapes of ferroalloys, slags and like remelt metals in multi-cavity iron or steel moulds wherein the mass of the mould is about 6 to 25 times greater than the mass of the castings. The molten metal or metallic slag is poured into the moving train of moulds which have been previously spray coated with a refractory slurry. The moving train of moulds is subjected to water sprays shortly after pouring to quench the castings and to stabilize the mould temperature below 500° C. High production yields and improved mould life are obtained.

9 Claims, 9 Drawing Figures

METHOD AND APPARATUS FOR CASTING FERROALLOYS AND SLAGS IN MOULDS HAVING A LARGE RATIO OF MOULD MASS TO CAVITY SIZE

BACKGROUND OF THE INVENTION

The present invention relates generally to the casting of metal alloys and more specifically, to the continuous casting of ferroalloys and slags into shapes for subsequent use as remelt alloys or as deoxidation additions in iron and steel making operations or like metallurgical processes.

In recent years, commercial users of ferroalloys and deoxidizing agents have increasingly specified that these products be supplied in relatively uniform cross-section for ease in handling by mechanized equipment and to insure uniform melting rates. For example, a material such as ferrosilicon is often specified by commercial users to be supplied in lumps with dimensions no greater than 75 mm, nor less than 25 mm.

Heretofore, in the conventional manufacture of ferroalloys, it has been common practice to cast a large plate or block of the material in iron moulds with the cast product having gross dimensions of approximately 800–1200 mm×800–1200 mm×25–150 mm. These moulds are usually mounted on a turntable device, holding ten or more such moulds, which revolves in a horizontal plane to permit filling of each moulds in sequence from a ladle, or the moulds are placed on the floor and cast either individually or by allowing metal to overflow in cascade fashion to two or more moulds arranged in steps.

Due to the fact that slags obtained in primary melting operations oftentimes contain valuable metallic elements which can be recovered by subsequent processing, it is also desirable to cast the slag into shapes which lend themselves to further reclamation operations. As such, slag is oftentimes cast in a similar manner as the ferroalloys.

After the cast ferroalloy or metallic slag material has cooled for a period of time, which may range from 30 minutes to 8 hours, the cast blocks, weighing upwards of one ton, are removed from the moulds and taken to a motorized crushing device where they are broken-up into smaller pieces. The crushed product is separated by size in a screening operation to eliminate the oversized and undersized particulate material. The properly sized material is then packed for shipment with the oversized material returned for additional crushing and screening while the undersized material, which is not lost or too fine, may be returned for remelt. This common production process, thus, entails high energy consumption in the crushing operation, coupled with a relatively high yield loss due to off-sized material and through the generation of fines. In addition, in the case of silicon alloys, these powder-like fines represent a toxic waste problem involving the dust collection and the resultant disposal thereof.

In addition to the high expense of operating and maintaining a crusher, it is not uncommon to generate product losses during the crushing and screening operations of over 30% of the quantity originally cast. Another major problem experienced is that since the temperature of the cast iron moulds is kept above 500° C. for extended periods, the moulds are subject to thermal stress cracking, resulting in expensive and frequent replacement of the moulds. A further problem which results from the slow cooling of large alloy castings is the metallurgical segregation of the various metallic elements which may cause a lack of chemical uniformity in the cast product. Portions of the casting which solidify first may contain a different alloy concentration than the last to solidify, in the central regions of the casting. Upon crushing, there may be a slight non-uniformity in the chemical composition occurring among the individual crushed particles.

It can, therefore, be appreciated that a significant advantage can be obtained by casting material directly to a desired shape and eliminating the crushing and screening operations. Prior attempts to produce ferroalloys and slag in this manner have been unsuccessful since the service life of the iron moulds has been relatively short so as to render the process uneconomical.

An attempt to cast ferroalloy shapes is shown in U.S. Pat. No. 3,429,362 which discloses a method of producing cast ferroalloy shapes with indented grooves or connecting "necks" between adjacent cavities to control breakage to a predetermined size after cooling in still air for about 6 minutes. Such a slow cooling practice ignores the threat of heat checking in iron moulds and resultant problems of mould deterioration. U.S. Pat. No. 3,581,809 discloses a device for casting ferroalloys comprising a rotary cylinder enclosed in a protective atmosphere and having a plurality of cavities on its outer surface. The problem of mould deterioration is apparently avoided through the use of expensive, graphite or water chilled copper moulds which can withstand prolonged periods at elevated temperatures without thermal degredation.

BRIEF SUMMARY OF THE INVENTION

The present invention provides a method and apparatus for casting remelt metals such as deoxidizers, ferroalloys and metallic slags which greatly increases the life of the iron or steel moulds and virtually eliminates the generation of fines heretofore encountered in the production of such castings. My invention further provides an economical method of producing cast ferroalloy and metallic slag bodies of controlled shape for ease in handling and possessing a uniform alloy chemistry throughout the individual castings.

Briefly, my invention is directed to a method and apparatus for economically producing cast bodies, the method comprising the steps of:

(a) providing a moving train of ferrous moulds, each having one or more cavities therein, the mass of each mould being between about 6 to 25 times greater than the mass of the bodies to be cast therein;

(b) coating the mould cavities with layer of refractory material;

(c) pouring molten ferroalloy or slag into the train of moving mould cavities;

(d) cooling the cast bodies and the moulds by water spraying; and (e) discharging the solidified cast bodies from the moulds while maintaining a steady state temperature in the ferrous moulds below about 500° C.

A preferred apparatus for practicing my invention comprises a continuous casting machine having a plurality of iron or steel moulds arranged in an endless train. The opposed ends of each mould are attached to a pair of endless chains which are suspended between a set of idler sprockets at the pouring end and a set of drive sprockets at the discharge end of the casting machine in a conventional manner. The moulds contain one or more cavities of a preselected dimension, and, in all cases, the mass of the moulds is at least 6 to 25 times greater than the mass of the ferroalloy or slag bodies to be cast therein. A preferred range is about 7 to 15:1 mass ratio. Molten metal is transferred to a pouring launder which has a plurality of nozzles or orifices in its side or bottom in matching, spaced relationship to the transverse array of cavities contained in the moulds. The casting machine also includes a conventional slurry mix tank and spray means positioned on the underside of the moving train of moulds to apply a light coating of refractory material, such as alumina, silica, magnesium oxide, zirconium oxide, and carbon, to the empty mould cavities as they pass above the spraying element. The heat remaining in the moulds tends to evaporate the water in the refractory slurry coating, leaving a thin, dry layer of refractory coating in the empty mould cavity. A heating device, such as a natural gas fired burner, may be provided to insure that the refractory coating is completely dry prior to pouring. After drying, the inverted, empty moulds, which are now coated with the refractory material, move around the pouring end sprockets of the casting machine to an upright pouring position beneath the launder to be filled with a molten ferroalloy or metallic slag material. As the moulds are continuously transported under the stream or streams of molten metal or slag, the material fills the moulds and solidifies into the desired shapes. Conventional overflow channels are provided between cavities and to the following mould to insure uniform cast product size. The casting machine also includes a plurality of conventional water spray units which direct water to the moulds and to the castings in spaced relationship from the pouring launder. Water sprays may also be mounted below the train of moulds to cool the outside surface of the moulds and to improve the heat transfer through the mould bottom and walls. After the cast product has solidified, the moulds travel around a set of sprockets at the drive end, causing the moulds to invert which permits the product to fall by gravity into a discharge chute. The discharge of the cast product from the moulds may also be assisted by a conventional rapping device which imparts a sharp blow to the mould or to the cast product at the discharge end. The empty moulds then travel toward the pouring end of the casting machine in an inverted position to be once again coated with the liquid slurry of refractory material.

BRIEF DESCRIPTION OF THE DRAWINGS

For a better understanding of my invention, attention is invited to the drawings, in which.

DETAILED DESCRIPTION OF THE INVENTION

Figure 1:
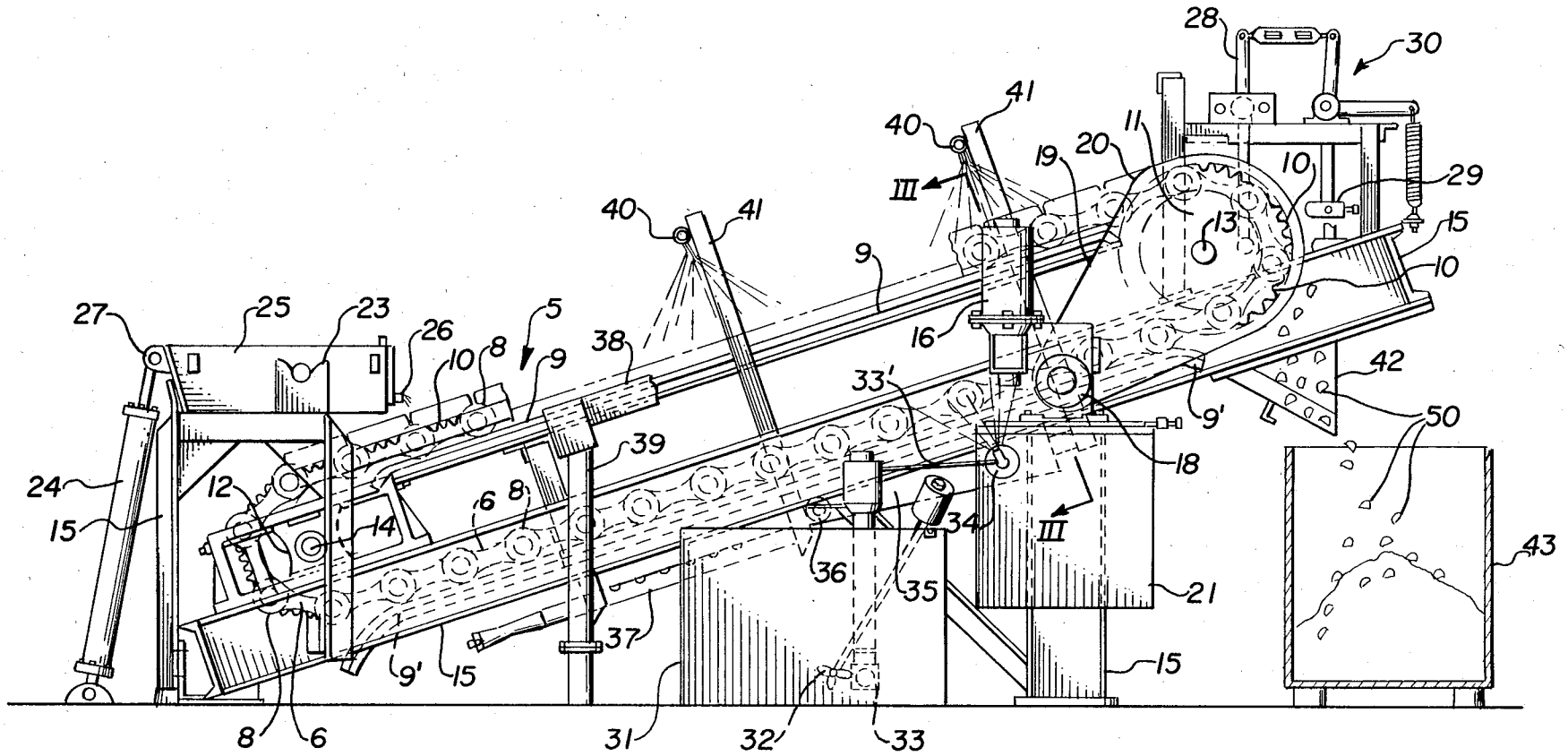
FIG. 1 is a partial, cut-away side elevation of a casting machine for practicing the invention.
Figure 2:
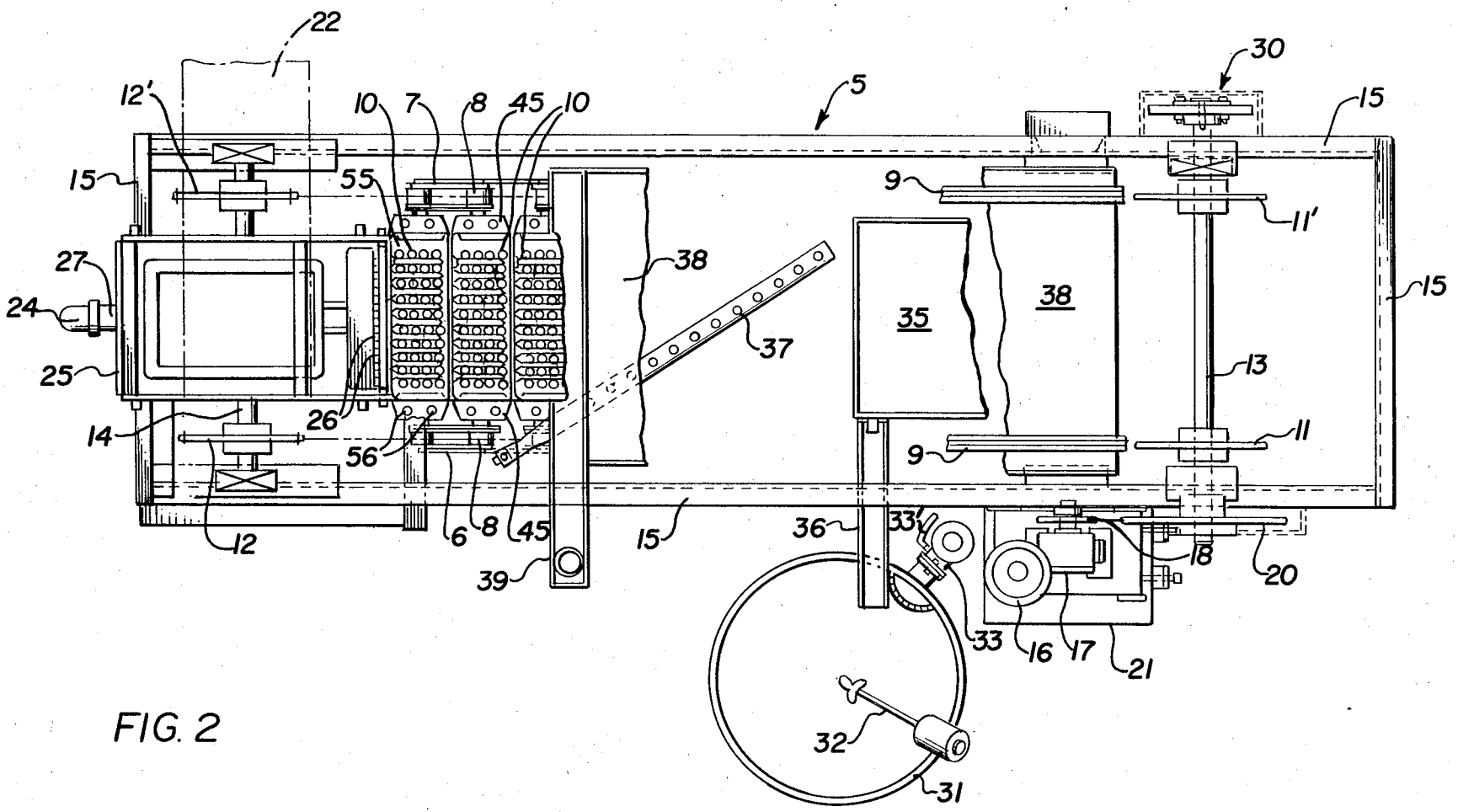
FIG. 2 is a partial, cut-away, plan view of the casting machine of FIG. 1.
Figure 3:
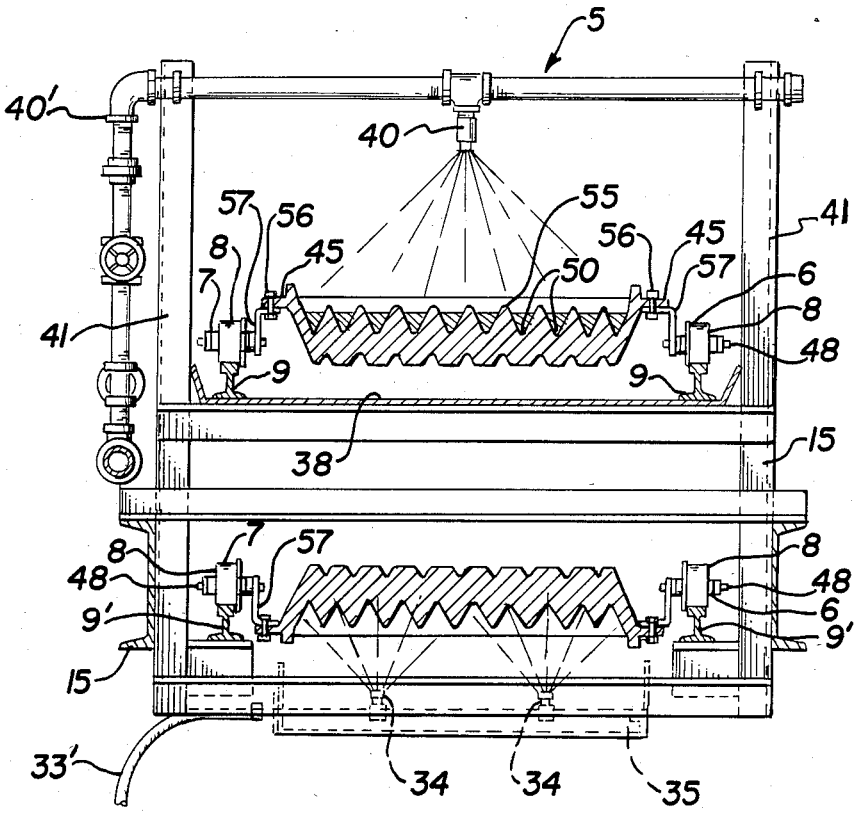
FIG. 3 is a section taken along lines III—III of FIG. 1.

Referring now to the drawings and specifically to FIGS. 1–3, a casting machine, generally designated 5, is depicted. The mechanical structure of the casting machine 5 is similar to those used in pig iron casting and comprises standard structural framing elements 15, first and second endless chain elements 6 and 7 supported by rollers 8 which ride on upper and lower rail elements 9 and 9', respectively. At the pouring end of the machine, the endless chains 6 and 7 are supported by tail sprockets 12 and 12' which, in turn, are mounted on a tail shaft or axle 14 and a pair of head sprockets 11 and 11' mounted on a head shaft or axle 13, at the driven end. The head sprockets 11 and 11' are turned by a gear wheel or pulley 20 which, in turn, is driven by a motor 16 powered by air, hydraulic, electricity or the like. An appropriate gear box and speed reducer 17 to drive pulley 18 and drive belt or chain 19 and a conventional electrical control panel box 21 are also provided. A plurality of ferrous moulds generally designated 10, having flanged elements 45 are mounted to the chain elements 6 and 7 by way of angle irons 57 and bolts 56, FIGS. 2–3. The specific features of the moulds 10 will be discussed in greater detail hereinafter.

A refractory lined pouring launder 25 is supported above the structural framing 15 of the casting machine 5, adjacent the idler sprockets 12 and 12' thereof for pouring molten ferroalloy or metallic slag into the moving train of moulds 10. The launder 25 may be tilted about support element 23 (FIG. 1) in a conventional manner, by way of a hydraulic cylinder 24 which is secured to an integral lug 27 to permit the molten metal to be poured from the launder. The launder 25 has a plurality of spaced-apart orifices or nozzles 26 preferably in its end and arranged in a row, transversely spaced across the mould, and aligned with each row of cavities. As shown in FIG. 2, there are ten nozzles 26 in the pouring launder 25, each of which is aligned with one of the ten rows of cavities in the cone mould 55 depicted therein. The nozzles 26 may also be formed in the bottom of the launder 25, if desired, but with the same transverse spacing as shown and described. Molten ferro-alloy or slag is transferred from a melting furnace to the pouring launder 25 by way of a conventional ladle or transfer trough 22, shown in phantom lines in FIG. 2. The casting machine 5 depicted in FIG. 1, is inclined such that the driving sprockets 11 and 11' are sloped higher in elevation than the tail sprockets 12 and 12'. In conventional manner, the molten metal or slag achieves a uniform level within the moulds 10, and undesirable flashing is minimized, with the excess liquid material flowing over appropriate channels to the mould immediately adjacent and behind a mould previously filled.

Still referring to FIGS. 1–3, moulding machine 5 also is equipped with a conventional spray nozzle 34 for applying a liquid slurry containing a refractory material to the moulds 10 prior to pouring. A conventional slurry mixing tank 31 is provided along with an agitator element 32 to keep the slurry in suspension. Known refractory mould wash materials such as alumina, silica, magnesium oxide, zirconium oxide and/or carbon mixtures are combined with water in the tank 31 in conventional fashion. The slurry is pumped by way of pump 33 through conduit 33' to the spray nozzle 34 whereupon the inverted empty mould cavities are lightly coated with the refractory mixture. A coating thickness of from 0.1 mm to about 5 mm is found to be satisfactory. The refractory coating not only provides additional heat insulation for the moulds during pouring, but it also greatly aids in releasing the cast product from the cavities.

Excess refractory slurry is collected in a drain basin 35 which is positioned beneath the spray head 34 to permit the excess liquid to be recycled to the mixing tank 31 through a return sluice 36. The refractory slurry coating should be thoroughly dried prior to casting and usually the heat remaining in the moulds during the process will be sufficient to dry the coating. During start-up operations it may be necessary, however, to provide auxiliary drying heat to the freshly coated moulds and a natural gas burner 37 is provided beneath the moulding machine 5 for this purpose.

The coated and dried moulds 10 proceed around the idler sprockets 12 and 12' to an upright position where they are filled with molten metal or slag beneath the pouring launder 25. The filled train of moulds 10 moves upwardly on the moulding machine 5 and, within several seconds after pouring, a solid skin of solidified metal forms on the top of each of the castings. In order to quickly chill the castings, such as the cone-shaped casting 50 shown in FIGS. 2–3, moulding machine 5 also includes a pair of conventional water sprays 40. Sprayheads 40 are connected to water pipes 40' which, in turn, are supported by bracing members 41 attached to the machine frame 15 in the usual manner. The forced, quick cooling provided by water sprays 40 not only yields a reduced cycle time but also is necessary in order to maintain the temperature of the moulds below the critical temperature at which heat checking becomes a problem. In heat resistant cast iron moulds, it is desirable to maintain the temperature thereof below 500° C. in order to prevent the deterioration caused by thermal stress cracking. At steady state temperatures above 500° C., a cast iron mould undergoes graphitization, which expands the material and creates voids therein. Cracks are then propagated which, naturally, will result in a premature scrapping of the mould. Specific mould configurations and mass ratios for practicing my invention will be discussed in greater detail hereinafter.

The unvaporized cooling water which is discharged from water sprays 40 is collected in a drain pan 38 which is disposed beneath the upper rails 9 on the machine 5. A drain sluice 39 collects the water for disposal in a suitable drain. The cooling water may be recycled through a known treatment means for reuse or disposal in conventional fashion, as desired. After the cast bodies and moulds 10 pass beneath the water sprays 40, they reach the driving sprockets 11 and 11' and gradually the moulds are moved to an inverted position by the endless chains 6 and 7. As can be seen in FIG. 1, the casting machine 5 is provided with a discharge chute 42 which directs the individual castings, such as cone-shaped castings 50, into a suitable collection bin 43 or like collection means.

In order to assist the discharge of the castings 50 from the moulds, a mechanical mould rapper, generally designated 30, may be provided at the discharge end of the casting machine 5. Mould rapper 30 is conventional in pig iron moulding machines and comprises an arm 28 which is moved by the rotating action of shaft 13, causing a reciprocal rapping motion in striker arm 29, which can be adjustably set so as to strike the moulds 10 or the castings themselves in order to dislodge the castings therefrom. Use of the refractory slurry mould coating supplied by spray 34 greatly enhances the ability of the castings to fall freely from the moulds by the action of gravity as they invert around the sprockets 11 and 11'.

A wide variety of shapes and sizes of ingots can be cast according to my invention from heat-resistant cast iron or steel moulds containing cavities of the desired shape. In designing a mold, it is important that the ratio between the mould mass and the cast product mass is greater than about 6 to 1 ranging to an upper about 25 to 1, and preferably between about 7 to 1 and about 15 to 1. It has been noted that in conventionally designed iron moulds, where the ratio of mould mass to cast product mass is less than about 4 to 1, the temperature of the mould continues to rise with each refilling thereof, even with water spraying, until a steady state temperature is reached in excess of 500° C., the temperature at which thermal stress cracking begins to occur in iron moulds. Heretofore, in order to minimize stress cracking problems, it has been common practice to modify the continuous casting operation, by periodically delaying pouring in order to permit the moulds to air cool further before being refilled. This prior practice, thus, decreases production rates.

The various shapes of ingot moulds 10 depicted in FIGS. 4 through 9 all possess identical gross dimensions so that they will interchangeably fit into the continuous casting machine 5 of FIGS. 1 through 3. The moulds 10 carry outwardly extending flanged portions 45 on opposed ends thereof with bolt holes 46 formed therein. As can best be seen in FIG. 3, the moulds are attached to the first and second chain elements 6 and 7, respectively, by way of an intermediate attachment member or angle iron 57 which is boltably secured to flanges 45 by way of bolts 56, secured within the holes 46 and situated between adjacent pairs of chain pins 48.

Figure 4:
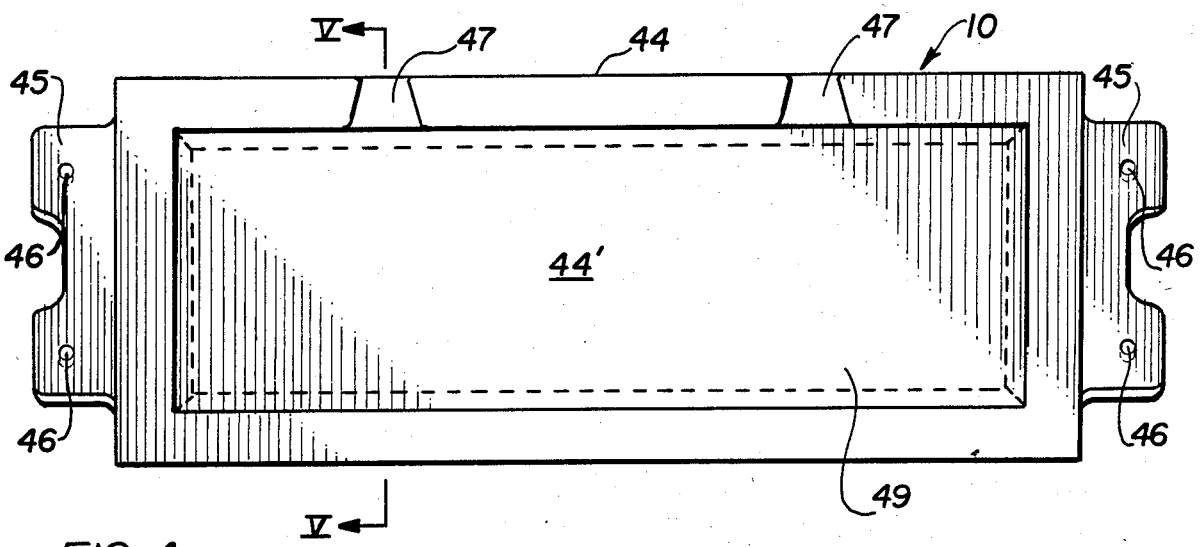
FIG. 4 is a plan view of a slab mould.
Figure 5:
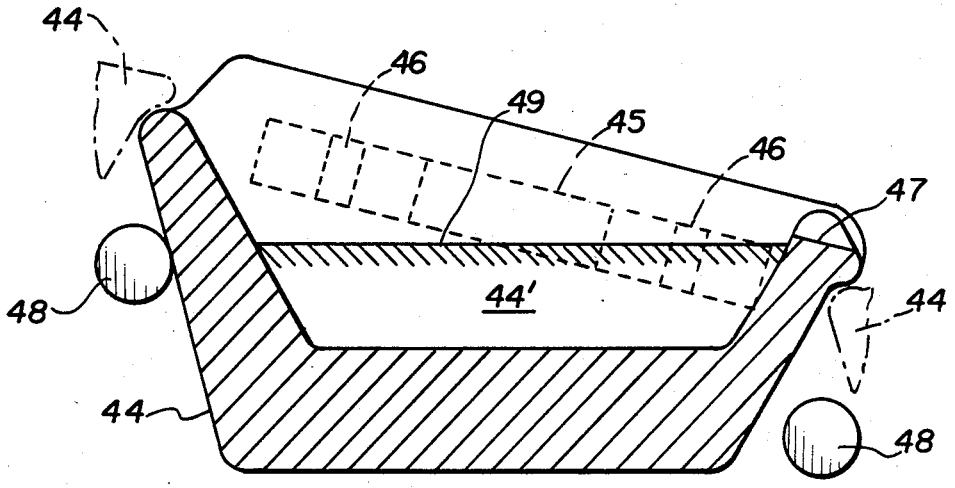
FIG. 5 is a section taken along lines V—V of FIG. 4.

A single slab casting is produced in the mould configuration 44 depicted in FIGS. 4 and 5. Mould 44 is approximately 500 pounds in weight and produces a slab-shaped ingot 44', which weighs approximately 80 pounds, thus yielding a mould to ingot mass ratio of 6.2 to 1. Mould 44 contains a pair of overflow channels 47 formed at its rearward edge to permit excess molten metal to flow rearwardly from the mould cavity and into a trailing mould so as to provide castings of uniform size.

Figure 6:
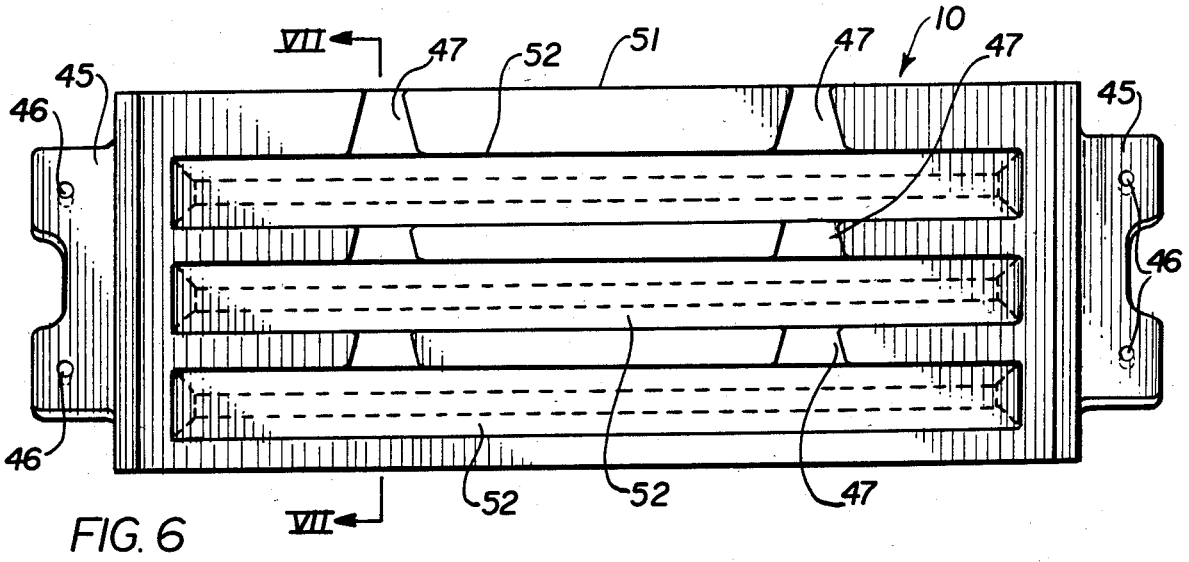
FIG. 6 is a plan view of a three cavity, bar mould.
Figure 7:
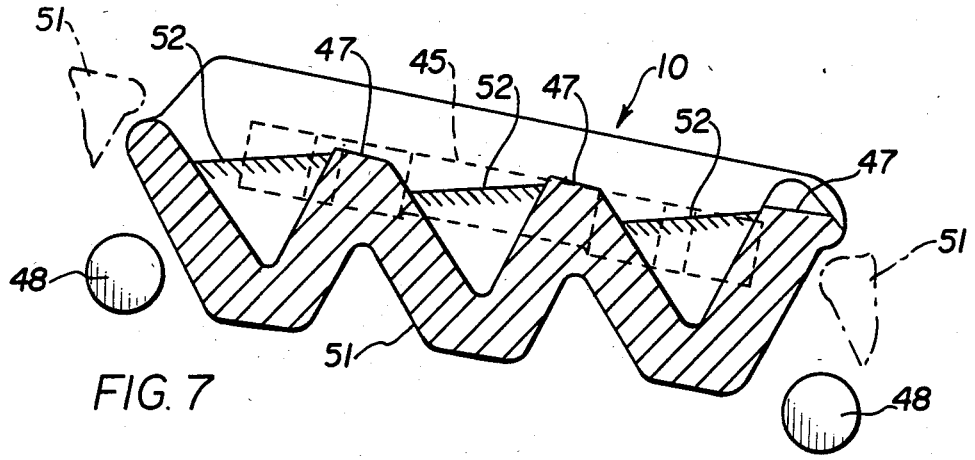
FIG. 7 is a section taken along lines VII—VII of FIG. 6.

Three bar-shaped cast ingots 52 are produced in the mould 51 depicted in FIGS. 6 and 7. Mould 51 also contains overflow channels 47 between adjacent ingot cavities and in the trailing edge of the mould so as to produce a uniform product. In this particular configuration, the mould 51 is approximately 400 pounds in weight while the total product casting weight is approximately 40 pounds, yielding a mould mass to ingot mass ratio of about 10 to 1.

Figure 8:
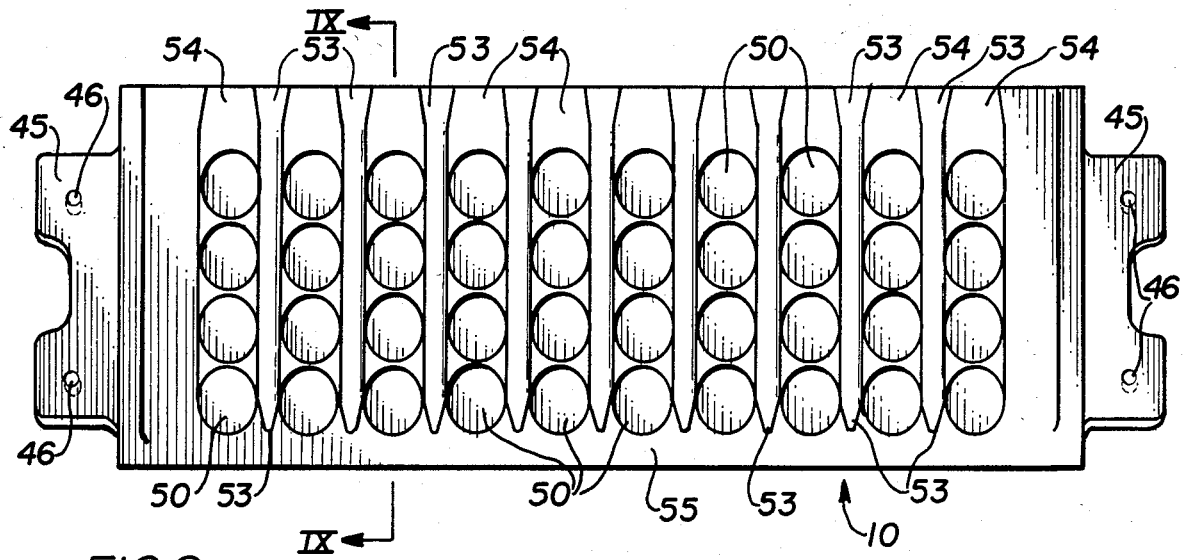
FIG. 8 is a plan view of a forty cavity, cone mould.
Figure 9:
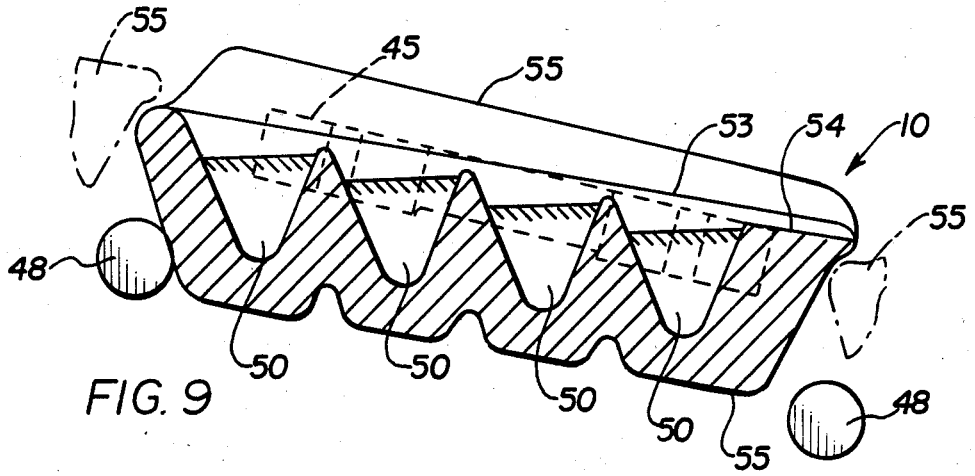
FIG. 9 is a section taken along lines IX—IX of FIG. 8.

A presently preferred mould embodiment for casting ferro-silicon alloys is the mould 55 depicted in FIGS. 8 and 9. Mould 55 produces forty individual, cone-shaped castings 50, which weigh approximately 400 grams each. The mould cavities 50 are situated between raised ridge portions 53 with flat regions 54 spaced therebetween. Flat regions 54 function as overflow channels at the rear edge of the mould 55 to permit the liquid metal to overflow into a rearwardly disposed mould during casting. The cone mould 55 has a mass of approximately 525 pounds and a total cast product weight of approximately 35 pounds, which yields a mould/ingot mass ratio of about 15 to 1.

In order to demonstrate the importance of water cooling in the casting of ferroalloys according to the invention, a laboratory test was run using an iron cone mould having a mould to product mass ratio of 15 to 1, utilizing a standard 77% FeSi ferroalloy with a carbon content of 0.12%. The cast cones weighed about 400 grams each. The alloy was melted in a laboratory induction furnace to a tap temperature of 3000° F. (1650° C.). A refractory slurry made from a mixture of alumina, silica and carbon was used to coat the mould cavity to a thickness of about 0.25 mm. Two recording thermocouples were inserted in the mould to read the mould temperature at a distance of about 1.5 mm from the inner mould surface. Using a 60-second cooling time, mould temperature tests were run using three sequential casts in the mould to investigate the mould temperature transients. In order to reduce the number of cycles required, the mould was first preheated to 400° F. (205° C.). The results are shown in Table I, below, which indicates that the mould temperatures continue to rise beyond 925° F. (496° C.) if the process were continued with no water cooling of the moulds.

TABLE I

| Time (sec.) | Operation | Mould Temperature |
|---|---|---|
| t = 0 | cast | 400° F. (205° C.) |
| t = 60 | discharge | 675° F. (357° C.) |
| t = 90 | apply mould coating | 625° F. (329° C.) |
| t = 120 | case | 525° F. (274° C.) |
| t = 180 | discharge | 750° F. (399° C.) |
| t = 210 | apply mould coating | 675° F. (357° C.) |
| t = 240 | cast | 600° F. (316° C.) |
| t = 300 | discharge | 925° F. (496° C.) |

Table 2 shows the same mould, ferrosilicon alloy, refractory lining, and pouring temperature, but with a cooling time of two minutes and the addition of water sprays after one minute had elapsed. Even though the mould was preheated to 600° F., (315° C.), to simulate heating from prior use, the temperature rise was only 82° C. After two minutes air cooling, the base temperature had dropped to 450° F. (232° C.). After three repetitions, a steady state peak temperature condition was reached at about 300° C., well below the temperature at which mould damage from thermal stress occurs. In addition, the indicated mould temperature fluctuation of less than 150° C. at steady state will prolong mould life dramatically over conventional techniques and lighter moulds of a 4:1 mass to product ratio, since most mould failures occur as a result of the propagation of thermal stress cracks which increases as mould temperature fluctuations become greater. The mould tested in Table II, having a mould mass-to-cast product ratio of 15 to 1, thus, acted somewhat as a stable heat sink and minimized the overall temperature fluctuation brought on by the water spray cooling step.

TABLE II

| Time (sec) | Operation | Mould Temperature |
|---|---|---|
| t = 0 | cast | 600° F. (315° C.) |
| t = 60 | apply water cooling | 780° F. (415° C.) |
| t = 120 | discharge | 775° F. (413° C.) |
| t = 180 | apply mould coating | 500° F. (260° C.) |
| t = 240 | cast | 450° F. (232° C.) |
| t = 300 | apply water cooling | 630° F. (332° C.) |
| t = 360 | discharge | 625° F. (329° C.) |
| t = 420 | apply mould coating | 430° F. (221° C.) |

TABLE II-continued

| Time (sec) | Operation | Mould Temperature |
|---|---|---|
| t = 480 | cast | 375° F. (191° C.) |
| t = 540 | apply water cooling | 560° F. (293° C.) |
| t = 600 | discharge | 550° F. (288° C.) |
| t = 660 | apply mould coating | 350° F. (177° C.) |
| t = 720 | cast | 310° F. (154° C.) |
| t = 780 | apply water cooling | 560° F. (293° C.) |
| t = 840 | discharge | 550° F. (288° C.) |

The cones tested, weighed approximately 400 gr. and had a side slope angle of 70° to the base, discharged freely from the mould when inverted, even at the initially elevated mould temperature. By contrast, most shapes cast in conventional casting machine moulds tend to stick in the moulds as the mould temperature rises. The product cast was structurally sound, and did not break when dropped a distance of about 5 meters onto a concrete floor. No cracks from later cooling were observed in any of the samples.

In order to demonstrate the importance of maintaining the ratio of mould mass to cast product mass at levels above 6 to 1, a computer model was devised. The computer program permitted the calculation of heat transfer from the cast product surface, first by radiation and then by water cooling. Simultaneously, the heat transfer from the product to the mould was calculated, yielding a mould temperature profile at the hottest point of the surface. The cooling of the mould after discharge was then calculated as it returned to the pouring point, where the cycle began again. The calculated data set forth in Tables III and IV were obtained for an 800 cubic inch block of 75% ferrosilicon alloy, cast at a temperature of 1650° C. (3000° F.). Table III represents temperature data on a water spray cooled mould having a bottom thickness of 50 mm and a mould-to-product mass ratio of 6 to 1. Table IV, under the identical conditions, represents a water spray cooled mould having a bottom thickness of 63 mm with a mould-to-product mass ratio of 7 to 1.

TABLE III

| | (50 mm thick mould) | |
|---|---|---|
| | Mould Temp. at Cast | Mould Temp. at Discharge |
| Cycle 1 | 76° F. (25° C.) | 860° F. (460° C.) |
| Cycle 2 | 482° F. (250° C.) | 1049° F. (565° C.) |

TABLE IV

| | (63 mm thick mould) | |
|---|---|---|
| | Mould Temp. at Cast | Mould Temp. at Discharge |
| Cycle 1 | 76° F. (25° C.) | 644° F. (340° C.) |
| Cycle 2 | 428° F. (220° C.) | 896° F. (480° C.) |

Thus, the above data indicates that, even with water spray cooling, it is necessary to utilize a mould-to-product mass ratio of more than 6 to 1 in order to prevent mould temperatures from rising above the critical temperature limit of 500° C., which was slightly exceeded in Table III. By increasing the thickness of the mould product mass ratio to a valve of 7 to 1 in Table IV, the peak temperatures were reduced to a level below the critical valve at which the thermal degredation problems begin.

It can, be readily appreciated that the method and apparatus of my invention is, thus, suitable for the efficient and economical production of cast ferroalloy bodies, including but not limited to, ferrosilicon, ferromanganese, ferrochrome, silicon as well as slag/metal mixtures, deoxidizers, and like molten materials characterized by a high melting point and high heat of fusion.

What is claimed is:

1. A method of continuously casting molten materials such as ferroalloys, deoxidizers, slags and the like, comprising the steps of:

(a) providing a train of moulds constructed of a ferrous material, each of said moulds containing at least one cavity formed therein, the ratio of the mould mass to the total mass of the cast product to be formed therein being greater than 6 to 1;

(b) pouring the molten material into the mould cavities;

(c) cooling the cast molten material in air to form a partially solidified cast product within the mould cavities;

(d) quenching the cast product and the moulds with a water spray means to further cool the cast product and the moulds; and (e) discharging the solidified cast product from the moulds.

2. The method of claim 1 including the step of coating the mould cavities with a layer of refractory material prior to the pouring step.

3. The method of claim 2 wherein the refractory material is a mixture comprising alumina, silica and carbon and is applied to the mould cavities in a thickness of about 0.25 mm.

4. The method of claim 2 wherein the molten material is a ferroalloy selected from the group consisting of ferrosilicon, ferromanganese, ferrochrome and silicon.

5. The method of claim 1 in which the ratio of the mass of the mould to the mass of the cast product is about 15 to 1 and wherein the water spray quenching step occurs about 1 minute after pouring and the discharge of the cast product occurs about 2 minutes after said pouring step.

6. A method of continuously casting molten materials such as ferroalloys, deoxidizers and slags, comprising the steps of:

(a) providing a moving train of moulds constructed of a cast iron material and having at least one cavity formed in each, the ratio of the mass of each of said moulds to the total mass of the cast product to be formed therein being between about 7 to 1 and 15 to 1;

(b) coating the mould cavities with a layer of refractory material;

(c) pouring the molten material into the moving train of mould cavities;

(d) cooling the cast molten material in air for a period of about 1 minute after pouring;

(e) quenching the cast product and the respective moulds with water spray means for a period of about 1 minute; and (f) discharging the cast product from the moulds.

7. The method according to claim 6 wherein the refractory coating step takes place about 1 minute after the discharging step and the pouring step occurs about 1 minute after said coating step.

8. The method of claim 7 wherein the refractory material is a mixture comprising alumina, silica and carbon and is applied to the mould cavities in a thickness of about 0.25 mm.

9. The method of claim 8 wherein the molten material is ferrosilicon.

* * * * *